US011246377B2

(12) United States Patent
Kim

(10) Patent No.: US 11,246,377 B2
(45) Date of Patent: Feb. 15, 2022

(54) WEIGHT-BEARING STRUCTURE FOR HIGH-HEELED FOOTWEAR

(71) Applicant: Il Soo Kim, Yongin-si (KR)

(72) Inventor: Il Soo Kim, Yongin-si (KR)

( * ) Notice: Subject to any disclaimer, the term of this patent is extended or adjusted under 35 U.S.C. 154(b) by 0 days.

(21) Appl. No.: 16/503,688

(22) Filed: Jul. 5, 2019

(65) Prior Publication Data

US 2019/0335856 A1 Nov. 7, 2019

Related U.S. Application Data

(63) Continuation of application No. PCT/KR2018/000074, filed on Jan. 3, 2018.

(30) Foreign Application Priority Data

Jan. 9, 2017 (KR) ..... 10-2017-0003111

(51) Int. Cl.

| | |
|---|---|
| ***A43B 21/24*** | (2006.01) |
| ***A43B 7/24*** | (2006.01) |
| ***A43B 7/30*** | (2006.01) |
| ***A43B 13/37*** | (2006.01) |
| ***A43B 7/22*** | (2006.01) |

(52) U.S. Cl.

CPC ..... *A43B 21/24* (2013.01); *A43B 7/223* (2013.01); *A43B 7/24* (2013.01); *A43B 7/30* (2013.01); *A43B 13/37* (2013.01)

(58) Field of Classification Search

CPC ..... A43B 21/24

See application file for complete search history.

(56) References Cited

U.S. PATENT DOCUMENTS

| | | | | |
|---|---|---|---|---|
| 1,609,918 A * | 12/1926 | Perugia | ..... | A43B 21/00 36/40 |
| 2,284,326 A * | 5/1942 | Korda | ..... | A43B 13/34 36/34 A |
| 2,284,328 A | 5/1942 | Korda | | |
| 2,399,543 A * | 4/1946 | Dack | ..... | A43B 21/30 36/106 |
| 4,085,525 A | 4/1978 | Wilkinson | | |
| 4,417,408 A * | 11/1983 | Metro | ..... | A43B 13/34 36/36 R |

(Continued)

FOREIGN PATENT DOCUMENTS

| | | |
|---|---|---|
| EP | 0980655 | 2/2000 |
| EP | 2862466 | 4/2015 |

(Continued)

OTHER PUBLICATIONS

EPO, Extended European Search Report of EP 18735948.4 dated Jun. 19, 2020.

*Primary Examiner* — Jila M Mohandesi
(74) *Attorney, Agent, or Firm* — Lex IP Meister, PLLC

(57) ABSTRACT

The present invention discloses a weight-bearing structure of high-heel footwear that is coupled to an outsole of high-heeled footwear, or in which a sole cover part becomes an outsole of the high-heeled footwear to linearly contact the ground during a loading response.

An embodiment of the present invention provides a weight-bearing structure of high-heeled footwear, including: a heel part linearly contacting the ground; a strut part extending from the heel part; and a sole cover part extending from the strut part.

18 Claims, 31 Drawing Sheets

(56) References Cited

U.S. PATENT DOCUMENTS

| | | | | |
|---|---|---|---|---|
| 8,112,908 | B2 * | 2/2012 | Visser | A43B 3/24 36/100 |
| 9,015,963 | B1 * | 4/2015 | Dominguez | A43B 3/246 36/42 |
| 9,259,053 | B2 * | 2/2016 | Dominguez | A43B 21/52 |
| 9,332,806 | B2 * | 5/2016 | Guardado | A43B 3/246 |
| 9,491,986 | B1 | 11/2016 | Dixon et al. | |
| 2009/0282702 | A1 * | 11/2009 | Brown | A43C 13/00 36/92 |
| 2014/0096413 | A1 * | 4/2014 | Anderson | A43B 3/246 36/100 |
| 2015/0264994 | A1 * | 9/2015 | Guardado | A43B 21/22 36/100 |
| 2016/0235163 | A1 * | 8/2016 | Alander | A43B 21/42 |
| 2017/0318910 | A1 * | 11/2017 | Hwang | A43C 13/00 |

FOREIGN PATENT DOCUMENTS

| | | | | |
|---|---|---|---|---|
| FR | 002869768 | A1 * | 11/2005 | A43B 21/39 |
| JP | 2005-511180 | | 4/2005 | |
| JP | 2005-131065 | | 5/2005 | |
| JP | 2007-014589 | | 1/2007 | |
| JP | 2013-539712 | | 10/2013 | |
| KR | 20-2000-0027296 | | 3/2001 | |
| KR | 20-0218226 | | 3/2001 | |
| KR | 10-2012-0078408 | | 7/2012 | |
| WO | 93-04604 | | 3/1993 | |

* cited by examiner (a)

(b)

(a)

(b)

Stability a < b

WEIGHT-BEARING STRUCTURE FOR HIGH-HEELED FOOTWEAR

TECHNICAL FIELD

The present invention relates to a weight-bearing structure of high-heeled footwear that may provide stability and a gait mechanism similar to that of barefoot or a low-heeled shoe.

BACKGROUND ART

Generally, high-heeled footwear refers to shoes of which heels are highly lifted, and it refers to high-heeled shoes in a broad sense, but particularly, refers to women's high-heeled shoes.

When a woman wears high-heeled footwear, as her hips go up, her miniskirt may look pretty, and as her upper body naturally tilts backwards, she may obtain an aesthetic effect such as appearance of a larger chest, thus the high-heeled footwear is preferred by a woman seeking beauty.

However, the high-heeled footwear causes various side effects because it does not absorb or disperse the varying loads according to the wearer's gait cycle. In other words, not only may a simple accident of falling down during a gait cycle occur, but also hallux valgus in which a big toe is bent toward the outside, ankle sprain, arthritis occurring due to a weight shift to the inside of a knee, and kyphosis in which a backbone is curved backward, may occur.

In a case of a wedge heel, an instability problem of a stiletto heel is not sufficiently resolved, and impact, weight absorption and dispersion according to the gait cycle are not properly achieved, and beauty of an original design of the high-heeled footwear is degraded due to a dull design.

DISCLOSURE

Technical Problem

Accordingly, the present invention has been made in order to solve the above-mentioned problems, and it is an object of the present invention to provide a weight-bearing structure of high-heeled footwear that may provide better stability than a wedge-type heel, increase beauty of a design, and suitably absorb and disperse loads that changed according to a gait cycle.

An embodiment of the present invention provides a weight-bearing structure of high-heeled footwear, including a heel part linearly contacting the ground a strut part extending from the heel part and a sole cover part extending from the strut part.

In the heel part, the portion thereof contacting the ground may preferably be formed to have a curved linear shape.

The heel part may preferably be formed to have a width of 2.12 cm or more.

The strut part may preferably include two or more struts.

The two or more struts may preferably be disposed to be parallel or symmetrical to each other.

The two or more struts may preferably be formed to have different shapes, or at least one thereof may preferably have a different shape from those of the other struts.

The two or more struts may preferably include one that supports one of a heel and a foot-arch part, and another that supports the other of a heel and a foot-arch part.

A heel strike part may preferably be provided in a rear region of the heel part.

The heel strike part may preferably be formed at one side of a rear region with respect to a center of the rear region.

The strut part may preferably be formed to have a forward curved shape.

A curvature of a posterior portion of the strut part may be greater than that of an anterior portion thereof.

The sole cover part may extend from the heel to a foot-arch or to a foot-ball, or may extend to cover the whole sole of the foot.

The strut part may preferably be formed to have a shape that is curved toward the outside.

At least a portion of the heel part may protrude more than a width of the sole cover part when viewed in a plan view.

The sole cover part may preferably extend from the heel to a foot-arch or to a foot-ball, or extend to cover the whole sole of the foot; the strut part and the sole cover part may preferably be connected by a connecting part; and a space part may preferably be provided between the sole cover part and the strut part.

The connecting part may preferably be formed to have a curved shape.

A groove part may preferably be provided at a lower portion of the sole cover part, and a stopper inserted into the groove part may preferably be formed by extending an upper portion of the strut part.

A ground contacting part, which linearly contacts the ground in midstance, may preferably be coupled to the heel part.

A gap part may preferably be provided between the heel part and the ground contacting part.

Advantageous Effects

According to the embodiments of the present invention, it is possible to increase stability by having the same or similar shape as an outer boundary line of a barefoot heel and having a broad base of support (BOS).

In addition, according to the embodiments of the present invention, since the movement of a body weight load line is performed near a center of a medio-lateral boundary of a stable area even while walking, it is possible to secure similar stability or higher stability to that when barefoot.

Furthermore, according to the embodiments of the present invention, it is possible to exhibit a normal gait mechanism because a ground reaction force (GRF) acts at a point where there is sufficient distance from a weight load line in an outward direction of the weight load line such that an external moment is generated inward.

Furthermore, according to the embodiments of the present invention, it is possible to reduce weight of high-heeled footwear itself through a heel part provided linearly and a strut part provided as two or more strut parts.

Also, according to the embodiments of the present invention, it is possible to realize an aesthetic sense through various shapes of a strut part.

In addition, according to the embodiments of the present invention, it is possible to naturally induce eversion-like movement at heel strike and loading response, resulting in a smooth and delayed movement of a subtalar joint, thereby absorbing or dispersing a weight load.

MODE FOR INVENTION

Figure 1:
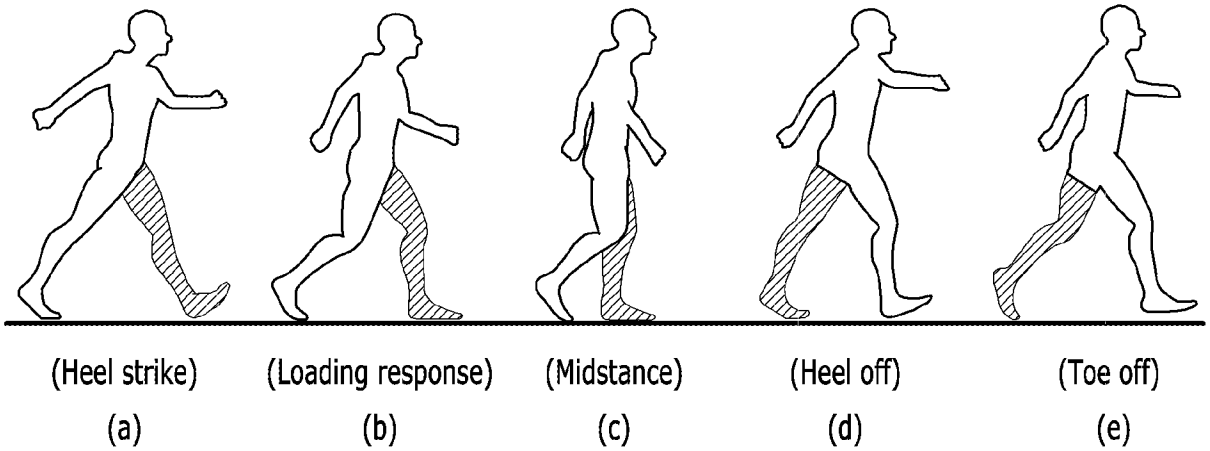
FIG. 1 illustrates a schematic view of a stance phase classified into five steps in order to explain a general human gait cycle.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

In the present specification, unless explicitly described to the contrary, the word "comprise" and variations such as "comprises" or "comprising" will be understood to imply the inclusion of stated elements but not the exclusion of any other elements.

A weight-bearing structure of high-heeled footwear according to an embodiment of the present invention, which linearly contacts the ground, will now be described in detail with reference to the accompanying drawings.

Hereinafter, unless otherwise described, a description is based on the right foot, and for the convenience of explanation, "medial" refers to being toward the midline of the body, "lateral" refers to being away from the midline of the body, "front side" refers to a direction toward a toe, "rear side" refers to a direction toward a heel.

Movement of a foot according to a gait cycle of a human of a bare foot or of human wearing general shoes is as follows.

In FIG. 1, (a) to (e) are schematic views for explaining a human gait cycle.

The human gait cycle is divided into a stance phase and a swing phase based on one foot (hatched portions in the drawing).

The stance phase is a state in which a portion of the foot contacts the ground while walking. The stance phase includes heel strike (FIG. 1 (*a*)), loading response (FIG. 1 (*b*)), midstance (FIG. 1 (*c*)), heel off (FIG. 1 (*d*)), and toe off (FIG. 1 (*e*)).

The heel strike means a moment when the outside of the heel contacts the ground during the stance phase. In this case, pronation and eversion are generated in the subtalar joint by the ground reaction force (GRF), so that an impact against the ground may be absorbed (as shown in FIG. 1 (*a*)).

The loading reaction is a process in which, while the entire sole contacts the ground after the heel strike, constant pronation occurs to absorb the impact applied to the foot and to disperse the body weight to adapt the foot to uneven ground (as shown in FIG. 1 (*b*)).

The midstance is a stage where the body weight is applied to the foot (as shown in FIG. 1 (*c*)).

The heel off is a stage where the heel of the foot is lifted up (as shown in FIG. 1 (*d*)).

The toe off is a stage where the toe of the foot is lifted up (as shown in FIG. 1 (*e*)).

On the other hand, the swing phase means a state in which the foot is away from the ground.

Walking is performed through the repetition of the stance phase and the swing phase.

Figure 2:
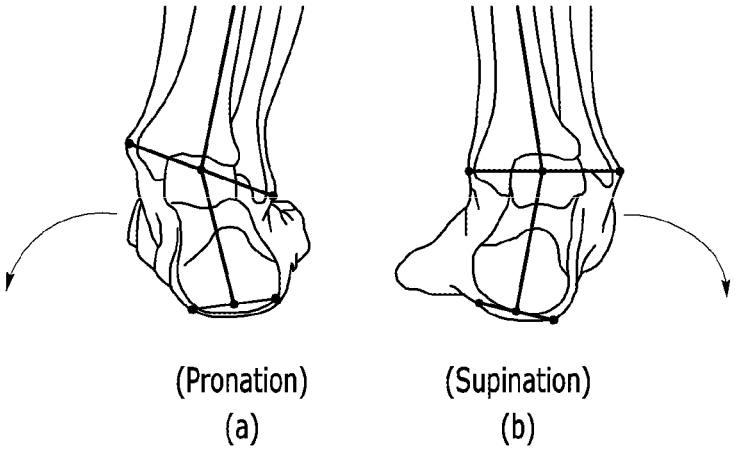
FIG. 2 illustrates schematic views of pronation and supination of a foot of a general human being while walking.
Figure 3:
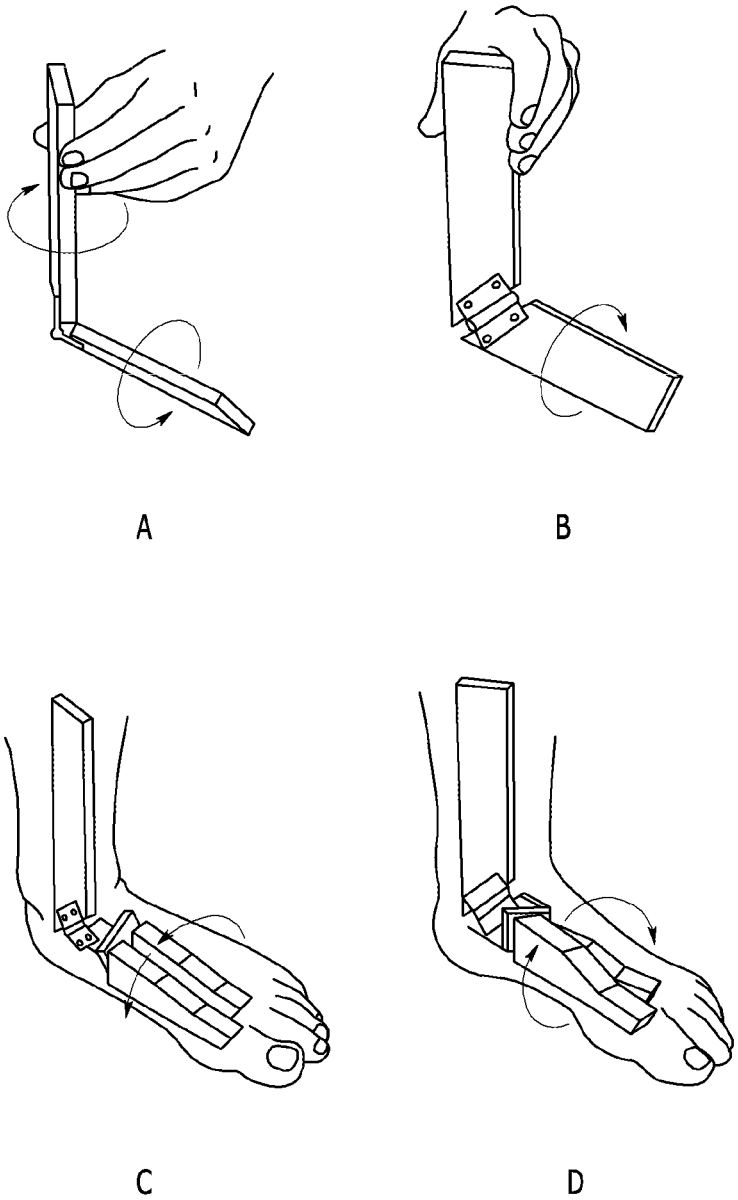
FIG. 3 illustrates model diagrams of pronation and supination of a foot of a general human being while walking.
Figure 4:
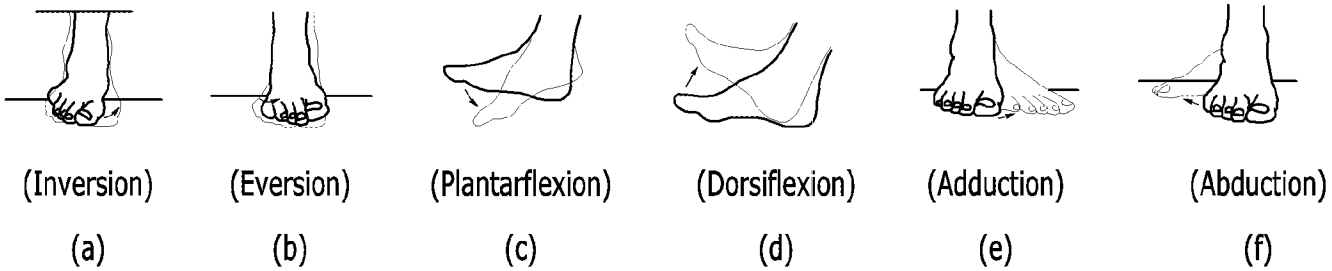
FIG. 4 illustrates a schematic view for explaining terms of a foot motion of a general human being while walking.

FIG. 2 to FIG. 4 are schematic views for explaining terms according to foot movements that may occur in a walking process. FIG. 2 is a schematic view of a state in which the ankle of the right foot is viewed from the rear, and FIG. 3 is a schematic view modeling the pronation and supination based on the left foot.

First, as shown in (a) of FIG. 2, the pronation means that the ankle portion moves in an arrow direction corresponding to the inside of the body based on the ankle of the right foot, and movements occur as shown in A and B of FIG. 3.

In addition, as shown in (b) of FIG. 2, the supination means that the ankle portion moves in a direction corresponding to the outside of the body based on the ankle of the right foot, and movements occur as shown in C and D of FIG. 3.

The inversion means that the foot moves such as with an inward twisting movement of the foot, as shown in (a) of FIG. 4.

The eversion means that the foot moves such as with an outward twisting movement of the foot, as shown in (b) of FIG. 4.

The plantarflexion means that the foot flexes in a plantar direction, as shown in (c) of FIG. 4.

The dorsiflexion means that the foot flexes in a direction toward the top side of the foot, as shown in (d) of FIG. 4.

The adduction means moving inward from a center line of the body, as shown in (e) of FIG. 4.

The abduction means moving outward from the center line of the body, as shown in (f) of FIG. 4.

In the swing phase described above, an open kinetic chain (OKC), which is a movement in which the distal part of the body (extremity of the limb) is freely performed, proceeds, and the foot enters the supination state. The supination is a state in which subtalar inversion, ankle plantarflexion and forefoot adduction simultaneously occur, and, in the swing phase, a length of the foot is shortened by locking the foot bones with each other due to the supination, and thus the foot becomes rigid levers.

During the heel strike, the ground reaction force (GRF) occurs while the heel contacts the ground. The foot that has become rigid levers in the swing phase is subjected to the ground reaction force (GRF) and the pronation occurs. In the pronation state, the subtalar eversion, the ankle dorsiflexion and the forefoot abduction of the ankle joint occur, and due to the pronation, the compressed foot spreads and becomes flexible, thus the foot absorbs the impact against the ground. Particularly, the subtalar eversion causes loosening between the foot bones, and after the heel strike, the loading response is continued and the subtalar eversion continuously occurs, so that the impact applied to the foot is absorbed, the weight loaded to the foot is dispersed, and the foot is adapted to uneven ground.

After the heel strike and the loading response, the pliant foot again becomes rigid to move forward by pushing the ground after the midstance. In other words, the supination occurs again after the midstance, and while the metatarsophalangeal joints are extended, the windlass effect occurs, and the foot again enters a rigid state.

Figure 5:
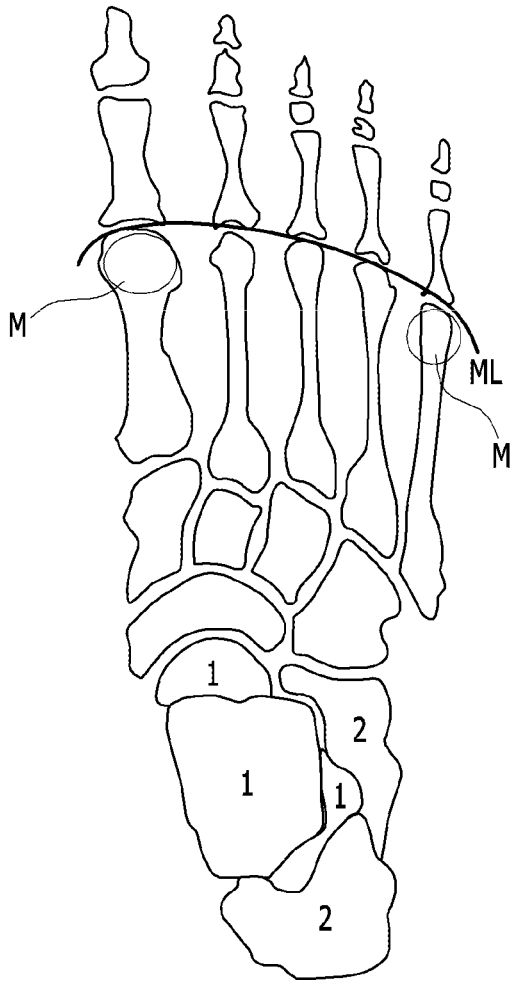
FIG. 5 illustrates a schematic view of a general human foot skeletal structure.
Figure 6:
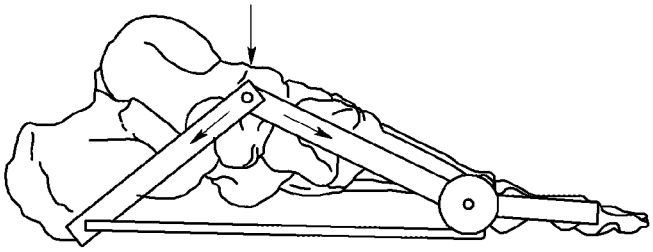
FIG. 6 illustrates a schematic view for explaining a windlass effect that occurs during a general human foot walking process.
Figure 6:
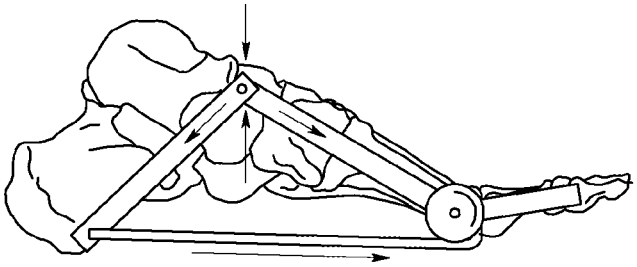
Figure 7:
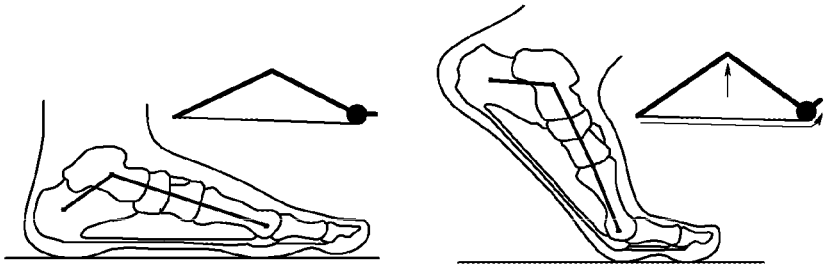
FIG. 7 illustrates a schematic view of a windlass effect according to a ground contact state of a foot.

FIG. 5 is a schematic view illustrating a portion where the extension and flexion occurs in the metatarsophalangeal joints with a line, and FIG. 6 and FIG. 7 are schematic views for explaining the windlass effect of the foot. After the midstance of the stance phase, the windlass effect of the foot occurs. According to the windlass effect of the foot, while the heel is away from the ground after the midstance, the metatarsophalangeal (MTP) joints (as shown in FIG. 4) are extended, thus the plantar fascia is tightened, and as a result, as the longitudinal arch of the foot is elevated, the foot bones are firmly locked with each other, and the foot is compressed and hardened.

Figure 8:
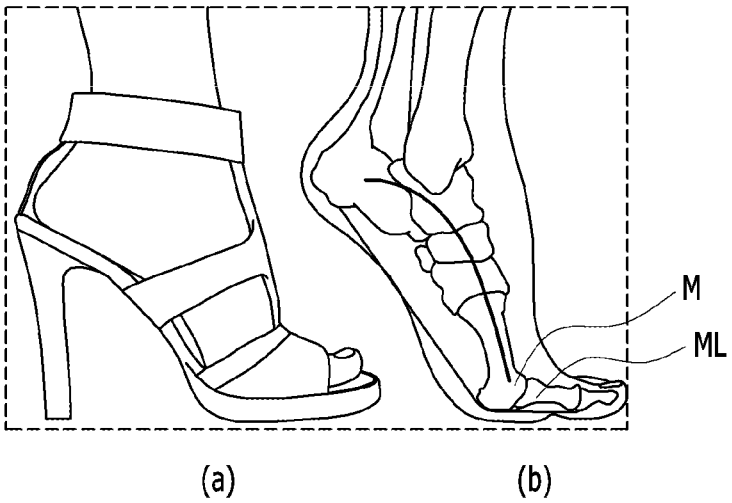
FIG. 8 illustrates a schematic view for explaining a state of a foot that is wearing typical high-heeled footwear.

In a case of wearing the high-heeled footwear, natural movement of the foot is extremely limited. (a) of FIG. 8 illustrates an outline view of a state of wearing the high-heeled footwear, and (b) of FIG. 8 illustrates the windlass effect in the state of wearing the high-heeled footwear.

Since the foot wearing the high-heeled footwear is always in the state of extension of the metatarsophalangeal joints, the windlass effect constantly occurs irrespective of the gait cycle. In addition, the excessive supination is maintained with the ankle plantarflexion, resulting in continuous limitation of motion of the ankle and foot joints.

In this state, the pronation does not occur even when the heel strike stage is entered, and the extension of the metatarsophalangeal joints is maintained, so that the impact against the ground is not absorbed and the weight loaded to the foot when contacting the ground is not dispersed.

In addition, wearing of typical high-heeled footwear may cause problems in terms of stability.

A region connecting the outermost points of all points contacting the ground is called a base of support (BOS), and the base of support (BOS) is closely related to stability while standing or walking.

Figure 9:
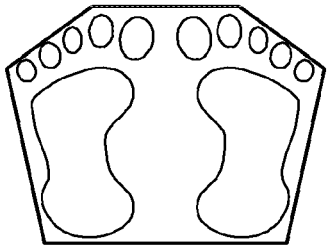
FIG. 9 illustrates a schematic view for explaining a relationship between a general base of support (BOS) and stability.
Figure 9:
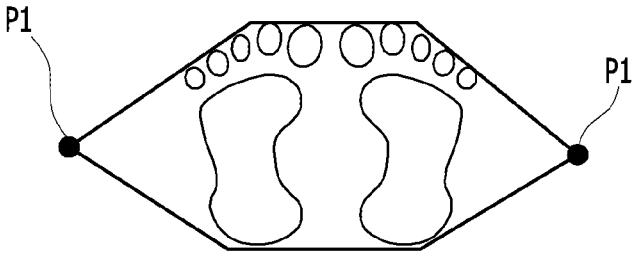

FIG. 9 is a schematic view for explaining a relationship between the base of support (BOS) and stability.

(a) of FIG. 9 illustrates a base of support (BOS) in a state in which the feet are slightly opened while standing. A solid line is the connection of the outermost points of the foot and represents the base of support (BOS). In addition, (b) of FIG. 9 illustrates a base of support (BOS) standing with crutches on both sides. In this case, the base of support is an area inside the solid line including a sole area. In (b) of FIG. 9, points P1 on respective sides are crutch ground contacting parts at which the crutches contact the ground.

Stability of (b) of FIG. 9 in which the base of support (BOS) is wide is good, and stability of (b) of FIG. 9 in which the base of support (BOS) is narrow is poor. That is, the width of the base of support (BOS) and stability of body are proportional to each other. In addition, a weight load line that extends to the ground along an axis of the leg must be inside the base of support to maintain stability.

Figure 10:
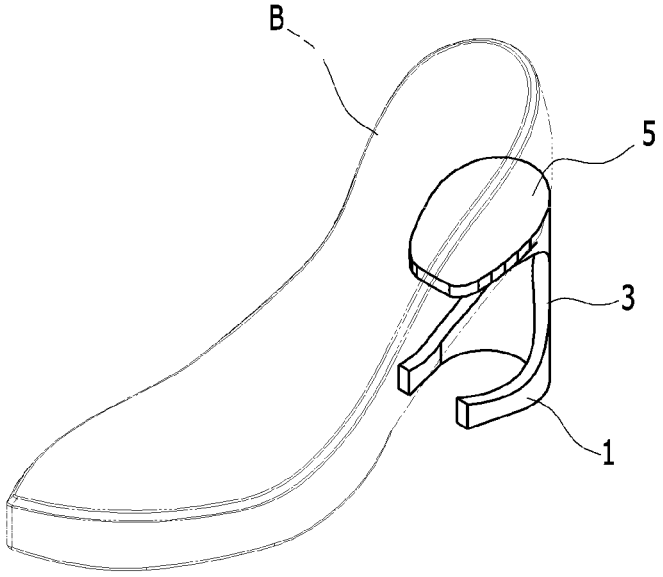
FIG. 10 illustrates a schematic view of high-heeled footwear to which a weight-bearing structure of high-heeled footwear is applied in order to explain a first embodiment of the present invention.
Figure 11:
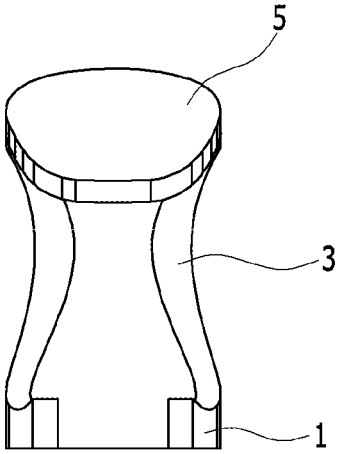
FIG. 11 illustrates a front view of main elements of FIG. 10.
Figure 12:
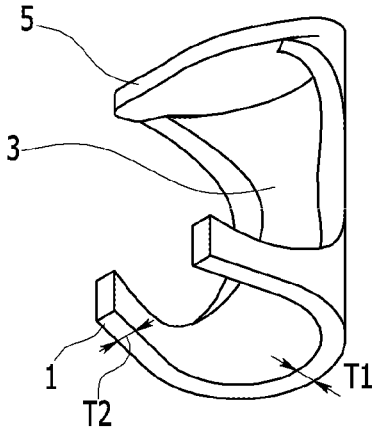
FIG. 12 illustrates a bottom perspective view of FIG. 11.

FIG. 10 is a schematic view of high-heeled footwear to which a weight-bearing structure of high-heeled footwear is applied in order to explain a first embodiment of the present invention, FIG. 11 is a front view of FIG. 10, and FIG. 12 is a bottom perspective view of FIG. 11. The high-heeled footwear includes a body portion (B) surrounding a person's foot and a weight-bearing structure coupled to the body portion (B).

The weight-bearing structure of the high-heeled footwear having linear contact with the ground according to the embodiment of the present invention includes a heel part 1, a strut part 3, and a sole cover part 5.

The heel part 1, which is a structure that contacts the ground while walking, contacts the ground linearly.

That is, the heel part 1 may be formed to have a round shape so that a portion of the heel part 1 contacting the ground or all including the portion has a predetermined thickness.

The heel part 1 is preferably formed to have the same shape as that of an outer boundary of a human heel.

Figure 13:
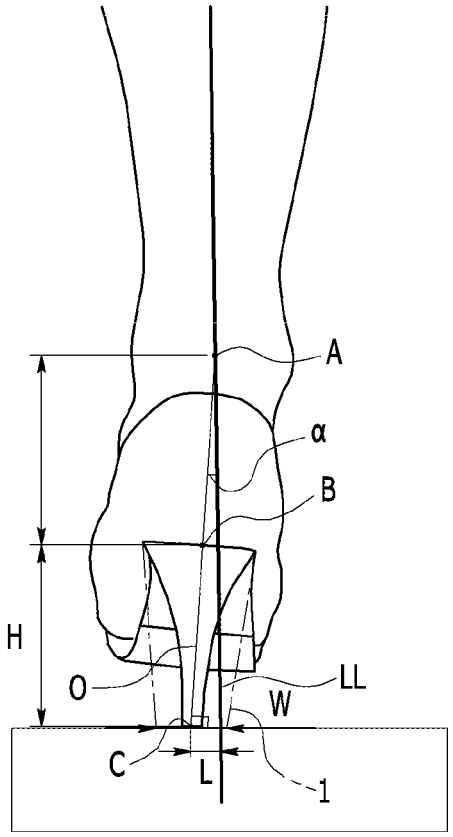
FIG. 13 illustrates a schematic view for explaining a process of obtaining an experimental result for a purpose of determining a width of a heel part.

FIG. 13 is a schematic view for explaining a procedure for obtaining experimental results for a purpose of determining a width W of the heel part 1 of the present invention.

In order to determine an appropriate width W of the heel part 1, a large number of women wearing stiletto heels were evaluated to determine an instantaneous inversion angle of the heel strike using high-speed video recording. Indication A, which is an intersection point of a heel center line O and a weight load line LL, is a starting point where the inversion occurs, and indication B is a topmost center point of the weight-bearing structure of the high-heeled footwear. As a result of evaluating a large number of women, an average value between indications A and B was found to be 7.5 cm. A deviation between the average value and an actual measured value was within ±0.35 cm, and an error range was relatively small, so the average value of 7.5 cm was used as a standard value for determining the width W of the heel part 1.

When an angle formed by the weight load line and the heel center line O is 'α', a height of the weight-bearing structure of the high-heeled footwear is 'H', and a distance from a lowermost point C of the heel center line O to the weight load line LL is 'L', the following equation is obtained.

$$\tan \alpha = L/(7.5+H)$$

As a result of performing evaluation of a large number of women, the a was an average of 4.489° for all women, but the a was an average of 5.384° for women who seldomly wear the high-heeled footwear. Table 1 and Table 2 show distances from the lowest point C of the heel center line O to the weight load line LL according to the evaluation results described above.

TABLE 1

<Distance 1 between lowest point of heel center line and weight load line>

| | Heel height (cm) | | | | | | | |
|---|---|---|---|---|---|---|---|---|
| | 6 | 7 | 8 | 9 | 10 | 11 | 12 | 13 |
| α = 4.489' (total average value) | 1.06 | 1.14 | 1.22 | 1.30 | 1.37 | 1.45 | 1.53 | 1.61 |
| α = 5.384' (average value of group seldomly wearing high-heeled footwear) | 1.27 | 1.37 | 1.46 | 1.56 | 1.65 | 1.74 | 1.84 | 1.93 |

TABLE 2

<Distance 2 between lowest point of heel center line and weight load line>

| | Heel height (cm) | | | | | | |
|---|---|---|---|---|---|---|---|
| | 14 | 15 | 16 | 17 | 18 | 19 | 20 |
| α = 4.489' (total average value) | 1.69 | 1.77 | 1.84 | 1.92 | 2.00 | 2.08 | 2.16 |
| α = 5.384' (average value of group seldomly wearing high-heeled footwear) | 2.23 | 2.12 | 2.21 | 2.31 | 2.40 | 2.50 | 2.59 |

The numerical value of the table derived by the evaluation described above may be used as a numerical value for determining the width W of the heel part 1. That is, the width W of the heel part 1 may be determined so as to be at least twice the value of the table according to the height H of the weight-bearing structure of the high-heeled footwear. For example, when the height of the structure is 9 cm, the width W of the heel part 1 may be determined to be 2.6 cm or more, which is twice the width of 1.30 cm.

Alternatively, the width of the heel part 1 that does not vary according to the height H of the weight-bearing structure of the high-heeled footwear may be selected, and the width W of the heel part 1 may be determined so as to maintain stability while walking based on the evaluation result described above. In this case, it is preferable that the width W of the heel part 1 is provided to be 2.12 cm or more based on the group that is familiar with the high-heeled footwear when the height H of the structure is 6 cm. More preferably, although the height H of the weight-bearing structure of the high-heeled footwear may sometimes be 20 cm, since the height H of the weight-bearing structure of the high-heeled footwear is generally 6 cm to 13 cm, the width W of the heel part 1 may be provided as 3.86 cm or more based on a group not usually wearing high-heeled footwear and on the height of the weight-bearing structure of 13 cm.

When the width W of the heel part 1 is 2.12 cm or more, a point where the weight load line LL contacts the ground is formed inside the base of support (BOS), so that stability may be secured. When the width W of the heel part 1 is 3.86 cm or more, a point where the weight load line LL contacts the ground is mostly formed inside the base of support (BOS), so that sufficient stability may be secured while walking.

In addition, a maximum value of the width W of the heel part 1 may be limited. For example, based on the case where the height H of the weight-bearing structure of the high-heeled footwear is 13 cm, the width W of the heel part 1 can be determined so that a point at which the weight load line LL contacts the ground may be formed at a midpoint between the lowermost point C of the heel center line O and a side of the heel part 1. In this case, the width W of the heel part 1 is 7.72 cm. As described above, by limiting the maximum value of the width W of the heel part 1, it is possible to prevent the deterioration of the aesthetics that may occur due to an excessively widened width W of the heel part 1.

In the heel part 1, a width between the free ends (portions facing a foot end) may be narrower than the maximum width.

In addition, the weight-bearing structure of the high-heeled footwear having linear contact with the ground according to the embodiment of the present invention may limit the thickness of the heel part 1 for linear contact with the ground.

A thickness T1 of the heel part 1 is a thickness of a middle portion contacting the ground surface of the heel part 1 as shown in FIG. 12, and a thickness T2 is a thickness of the free end portion facing a front direction.

The thickness of the heel part 1 is not necessarily constant, and the thickness may partially vary.

The maximum width of the heel part 1 may be limited, and the maximum width of the heel part 1 is preferably 1.8 cm or less. When the maximum thickness value of the heel part 1 exceeds 1.8 cm, the linearity at the time of contacting the ground may be reduced, and since its shape becomes dull, the perceived aesthetics may be deteriorated.

In addition, the thickness of the heel part 1 may be provided so as to become thicker in the middle portion (denoted by T1) and thinner toward the free end T2 in terms of design and stability.

The heel part 1 may be made of various elastic materials such as a non-metallic material such as a plastic or metal.

As described above, the heel part 1 contacting the ground may linearly contact the ground at the loading reaction of the stance phase, and the total weight of the high-heel footwear may be reduced.

Such an embodiment of the present invention may improve stability of walking, and may reduce the weight of the high-heel footwear, thus the walking may be convenient.

In a typical gait cycle, when the heel strike occurs, a point or linear contact with the ground occurs, but after the loading response, a surface contact in which the sole contacts the ground occurs. In reality, there are no perfect 'point' and 'line', so the 'point' and 'line' described above are relative concepts corresponding to a 'surface'. Therefore, a 'point' and 'line' will be described as a relative concept corresponding to a 'surface'.

In the heel region after the loading response, a point contact occurs in the case of the stiletto heel, and a surface contact occurs in the case of the wedge heel.

The weight-bearing structure of the high-heeled footwear having linear contact with the ground according to the embodiment of the present invention also linearly contacts the ground at the heel region after the loading response.

The heel part 1 of the weight-bearing structure of the high-heeled footwear having linear contact with the ground according to the embodiment of the present invention may be provided to curved-linearly contact the ground. For example, the heel part 1 may be provided to have a shape in which the front portion is opened and the rear side is curved in a round shape.

The weight-bearing structure of the high-heeled footwear having linear contact with the ground according to the embodiment of the present invention is more stable because the base of support (BOS) thereof is wider than that of the wedge heel when standing. In addition, since the base of support (BOS) is influenced by the width of the heel part 1 at the time of the heel strike, stability is improved while walking.

In addition, since the heel part 1 maintains the linear contact with the ground, the weight of the high-heeled footwear may be reduced compared to the weight of wedge heels, which perform surface contact with the ground.

When the heel part 1 is made of an elastic material, it is possible to reduce the impact of the heel strike that directly applies to the ankle joint, the subtalar joint, the knee joint and the like.

The strut part 3 extends from the heel part 1. The strut part 3 may serve a function of maintaining the height of the high-heeled footwear while connecting the sole cover part 5 and the heel part 1. The strut part 3 may be provided as a single strut part having the same or similar shape as the cross-sectional shape of the heel part 1.

The strut part 3, which extends from a posterior portion of the heel part 1 to be connected to the sole cover part 5, will be exemplarily illustrated and described in the first embodiment of the present invention.

The strut part 3 of the first embodiment of the present invention has a convex round shape toward the rear side with a constant thickness, and a round shape in which the front portion is opened.

The strut part 3 of the first embodiment of the present invention may have the same thickness as the heel part 1. In addition, the strut part 3 of the first embodiment of the present invention may be provided with an opened side space. That is, the strut part 3 may be connected to the sole cover part 5 only at a rear side of the heel part 1, and a side portion thereof may be open. The strut part 3 of the first embodiment of the present invention may be formed to have a curved shape in which their side portions to which the heel part 1 and the sole cover part 5 are connected are curved, that is, a concave shape toward the front.

The structure of the strut part 3 of the present invention may secure the stability of the high-heeled footwear, make it lighter than the conventional one and enhance aesthetic appearance thereof.

Particularly, the shape connecting the heel part 1 and the sole cover part 5 of the strut part 3 of the present invention may be structured to absorb the impact while maintaining structural stability.

The strut part 3 may be made of various elastic materials such as a non-metallic material such as plastic or metal. When the strut part 3 is made of an elastic material, it absorbs an impact generated during the heel strike, so that an impact applied to the human body may be sufficiently absorbed. The heel part 1, the strut part 3 and the sole cover part 5 of the present invention may be integrally molded or formed with the same material.

The sole cover part 5 is provided to extend to the strut part 3. The sole cover part 5 may be connected to the outsole or the body portion B of the high-heeled footwear.

The rear portion of the sole cover part 5 of the first embodiment of the present invention may be connected to the strut part 3.

The heel part 1, the strut part 3, and the sole cover part 5 may be designed to have a predetermined thickness, to have a space therein so as to be lighter, and to have a beautiful appearance.

Figure 14:
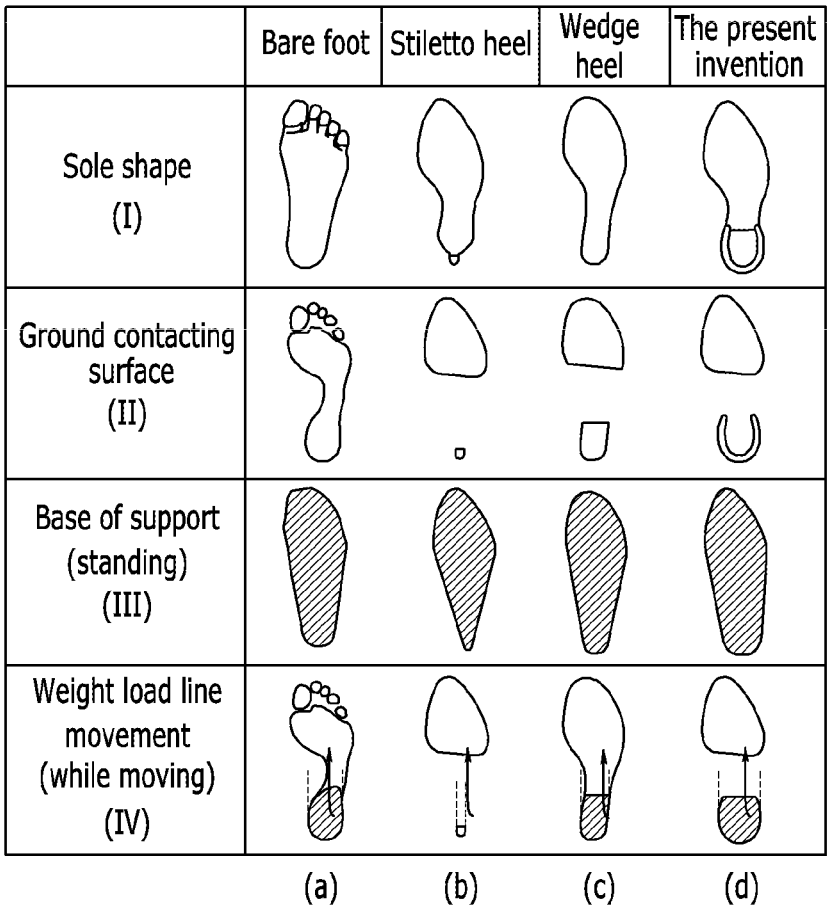
FIG. 14 illustrates a schematic view for expressing the comparison of a base of support (BOS) and a weight load lines between barefoot gait, gait with a stiletto heel, with a wedge heel and with an embodiment of the present invention.

FIG. 14 is a drawing of the comparison of the base of support (BOS) and the weight load line between prior art and the embodiment of the present invention.

FIG. 14 (I) is a drawing comparing the bottom shapes of the bare foot, the stiletto heel, the wedge heel, and the embodiment of the present invention.

FIG. 14 (II) is a drawing comparing the shapes of surfaces on which the bare foot, the stiletto heel, the wedge heel, and the embodiment of the present invention contact the ground. FIG. 14 (III) is a drawing comparing the bases of support (BOS) (shown with hatching) of the bare foot, the stiletto heel, the wedge heel, and the embodiment of the present invention.

FIG. 14 (IV) is a drawing expressing the comparison of the bases of support (BOS_hatched area) and the weight load lines (shown with an arrow) between barefoot gait, gait with a stiletto heel, with a wedge heel and with the embodiment of the present invention. In FIG. 14 (IV) (d), the movement means movement before the loading response (before the toe contacts the ground) after the heel strike. The dashed lines of FIG. 14 (IV) indicate a boundary of the medio-lateral border of the stable area formed by the base of support (BOS) during moving. Referring to FIG. 14 (III), it can be seen that the base of support (BOS) of the stiletto heel is the narrowest and thus the stability thereof is the lowest while standing. The wedge heel has somewhat higher stability due to the wider base of support (BOS) than the stiletto heel, but is less stable than bare feet.

Referring to FIG. 14 (IV), arrows indicate the movement of the weight load line while the heel strike progresses to the loading response thereafter, and the dashed lines indicate the medio-lateral boundary of the stable area formed by the base of support (BOS) of the heel structure. In the case of the stiletto heel, walking may be very unstable because the load-line movement occurs outside the medio-lateral boundary of the stable area. Because of the instability during the walking, the heel strike is skipped in the gait cycle and the loading response may immediately be performed, and according to such a walking pattern, the impact generated during the ground contact is not absorbed, thus the impact is applied to a joint as it is.

Even in the case of the wedge heel, since the load-line movement occurs near a border of the medio-lateral boundary of the stable area, the stability is degraded.

The embodiment of the present invention shown in FIG. 14 (IV) (d) shows that the movement of the load line occurs near a center line of the medio-lateral boundary of the stable area, thus the stability may be secured while walking.

Figure 15:
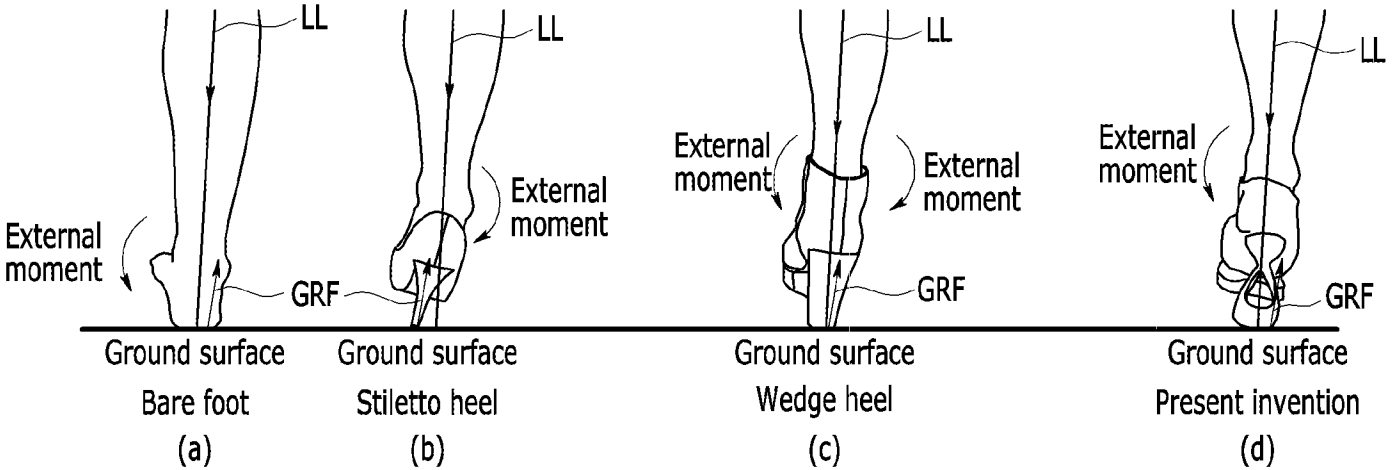
FIG. 15 illustrates a schematic view for explaining a relationship between a weight load line, a ground reaction force (GRF), and an external moment.

In FIG. 15, (a), (b), (c), and (d) show a relationship between the load line, the ground reaction force (GRF) and the external moment during the walking in the cases of the bare foot, the stiletto heel, the wedge heel, and the embodiment of the present invention, respectively. In the case of the stiletto heel, the risk of ankle injury, being usually caused by excessive inversion of a plantarflexed foot, is increased since there is a point of action of the ground reaction force in a medial side with respect to the load line, which allows the external moment to cause the inversion movement of the foot.

In the case of the wedge heel, there is a point of action of the ground reaction force in the lateral side with respect to the load line. However, since a point where the load line comes into contact with the ground is close to the point of action of the ground reaction force, there is still a risk of injury to the ankle because the external moment may cause the inversion movement of the foot in actual walking and ground situations.

When the stiletto heel or the wedge heel are worn, the impairment of impact and weight load absorbtion during heel strike and loading response occurs because of progressing into midstance without sufficient heel strike and loading response in order to avoid the risk of above mentioned ankle injury.

In the case of the embodiment of the present invention, as in the case of the bare foot, there is a point of action of the ground reaction force (GRF) in the lateral side with respect to the load line, and the point where the load line comes into contact with the ground and the point of action of the ground reaction force are sufficiently separated, thus sufficient external moment causes stable eversion movement of the foot. In addition, the embodiment of the present invention provides more stable walking since the direction of the external moment generatedby the ground reaction force (GRF) is similar to that of the barefoot gait.

An effect of of the weight-bearing structure of the high-heeled footwear having linear contact with the ground according to the embodiment of the present invention will now be described.

Since the weight-bearing structure of the high-heeled footwear having linear contact with the ground according to the embodiment of the present invention is provided so that the heel part 1 conforms to the shape of the outer border of the barefoot heel, the width thereof is similar to or wider than that of the base of support (BOS) of the bare foot. Therefore, the weight-bearing structure of the high-heeled footwear having linear contact with the ground according to the embodiment of the present invention may provide very high great stability.

In the case of the weight-bearing structure of the high-heeled footwear having linear contact with the ground according to the embodiment of the present invention, even when walking, since the movement of the load line thereof occurs within the medio-lateral boundary of the stable area, the stability thereof may be similar to or better than that of the bare foot.

In the case of the weight-bearing structure of the high-heeled footwear having linear contact with the ground according to the embodiment of the present invention, as in similar to the barefoot case, the ground reaction force acts sufficiently far to the lateral side with respect to the load line, and sufficient external moment generated by the ground reaction force (GRF) causes stable eversion movement of the foot. Therefore, it is possible to efficiently absorb the impact and weight load that occur while walking.

In addition, the weight-bearing structure of the high-heeled footwear having linear contact with the ground according to the embodiment of the present invention may reduce the weight of the high-heeled footwear compared to the wedge heel because the heel part 1 is linearly provided.

Further, in the weight-bearing structure of the high-heeled footwear having linear contact with the ground according to the embodiment of the present invention, the strut part 3 is provided to have a round shape with a constant thickness, or is provided with two or more struts, thus it is possible to reduce the weight of the high-heeled footwear. Particularly, when the strut part 3 is provided with two or more support members, unlike the dull shape of the wedge heel, the strut part 3 may be formed of various types of support members, thus various design variations may be possible, thereby achieving an excellent effect in terms of design.

A mechanism for absorbing the impact and weight load of the weight-bearing structure of the high-heeled footwear according to the embodiment of the present invention will now be described.

The weight-bearing structure of the high-heeled footwear according to the embodiment of the present invention naturally induces an eversion-like motion in the heel strike and the loading response, and thus, the subtalar joint may be subjected to smooth and delayed movement to absorb or disperse the impact and the weight load.

In the weight-bearing structure of the high-heeled footwear according to the embodiment of the present invention, when the heel part 1, the strut part 3, and the like are made of elastic material, a predetermined amount of the impact occurring during the heel strike is absorbed by elasticity, thus it is possible to prevent the impact from being applied to the ankle joint, the subtalar joint, the knee joint, and the like as it is.

The ground reaction force (GRF) occurs during the heel strike, and causes a moment rotating the weight-bearing structure of the high-heeled footwear in a downward direction toward the ground as viewed from the side and in a medial direction as viewed from the rear with respect to the ground contact point where the ground reaction force (GRF) acts. The weight-bearing structure of the high-heeled footwear having linear contact with the ground according to the embodiment of the present invention absorbs the impact while the rear region of the strut part 3 spreads during the heel strike, and reduces the rotational moment. Thus it is possible to perform a function of converting a sudden motion of the joint into a smooth and delayed motion.

Figure 16:
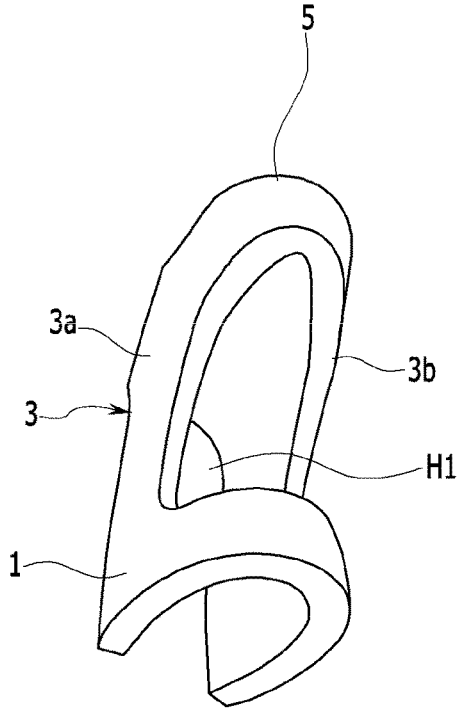
FIG. 16 illustrates a schematic view of a weight-bearing structure of high-heeled footwear for explaining a second embodiment of the present invention.

FIG. 16 illustrates a schematic view of a weight-bearing structure of high-heeled footwear for explaining a second embodiment of the present invention.

In a description of a different embodiment from the embodiment of the present invention described above, a description of the same elements as those of the above-described embodiment will be omitted, and a difference from the above-described embodiment will hereinafter be described.

A shape of the heel part 1 of the second embodiment of the present invention is the same as that of the structure having linear contact with the ground.

In the second embodiment of the present invention, the strut part 3 may be configured to include two struts 3*a* and 3*b*. When the strut part 3 is provided with two struts 3*a* and 3*b*, the two struts 3*a* and 3*b* may be linearly parallel to each other. The two struts 3*a* and 3*b* may be provided so as to extend from the inside and the outside of the heel part 1 and support the inside and outside of the sole cover part 5, respectively.

In the strut part 3 of the second embodiment of the present invention, a portion in a backward direction of the heel thereof is penetrated in a longitudinal direction of the foot. The strut part 3 may extend from a front end part of the heel part 1 (a portion toward the toe) to be coupled to the sole cover part 5.

In addition, the second embodiment of the present invention may be configured so that when the strut part 3 is coupled to the sole cover part 5, the support portion 3 may be inclined upward in a side view. In other words, when the weight-bearing structure of the high-heeled footwear is viewed in a side thereof, the strut part 3 may extend to be inclined from the heel part 1 to the posterior portion (rear side) of the sole cover part 5.

In the second embodiment of the present invention, the first strut 3*a* may extend from the outside of the heel part 1 to support the inside of the sole cover part 5, and the second strut 3*b* may extend from the inside of the heel part 1 to support the outside of the sole cover part 5, and in this case, the first and second struts 3*a* and 3*b* may be formed so as to intersect each other.

The second embodiment of the present invention may be configured to have various shapes to beautifully improve the appearance thereof.

Figure 17:
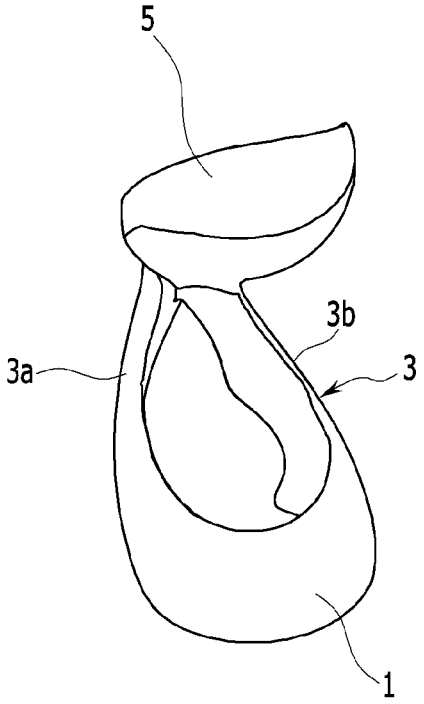
FIG. 17 illustrates a schematic view of a weight-bearing structure of high-heeled footwear for explaining a third embodiment of the present invention.

FIG. 17 illustrates a schematic view of a weight-bearing structure of high-heeled footwear for explaining a third embodiment of the present invention.

Compared with the aforementioned embodiments, features of the third embodiment that are different from the aforementioned embodiments will be mainly described.

In the third embodiment of the present invention, the strut part 3 may be configured to include two struts 3*a* and 3*b*. One (3*b*) of the two struts 3*a* and 3*b* may support a posterior portion of the sole cover part 5. The other one (3*a*) of the two struts 3*a* and 3*b* may be provided in a form of supporting an anterior portion of the sole cover part 5.

The two struts 3*a* and 3*b* may be provided to have a curved shape, respectively. The two struts 3*a* and 3*b* may be provided to be asymmetric or to have different shapes. The two struts 3*a* and 3*b* may be formed so as to intersect each other when viewed from a rear side.

In another example of the third embodiment of the present invention, one strut may be connected to one side of the sole cover part 5, and the other strut may be connected to the opposite side of the sole cover part 5, or to the anterior portion of the sole cover part 5.

When the third embodiment of the present invention is made with an elastic body, it may be more advantageous in dispersing the body weight, and may further enhance the beauty of appearance thereof.

Figure 18:
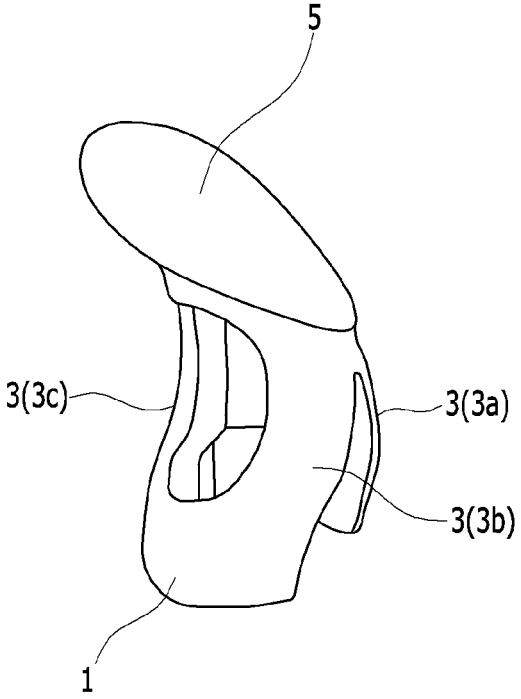
FIG. 18 illustrates a schematic view of a weight-bearing structure of high-heeled footwear for explaining a fourth embodiment of the present invention.

FIG. 18 illustrates a schematic view of a weight-bearing structure of high-heeled footwear for explaining a fourth embodiment of the present invention.

Compared with the aforementioned embodiments, features of the fourth embodiment that are different from the aforementioned embodiments will be mainly described.

The strut part 3 of the fourth embodiment of the present invention may be configured to include three or more struts 3*a*, 3*b*, and 3*c*. The three or more struts 3*a*, 3*b*, and 3*c* may include a first strut 3*a* for supporting the inside of the sole cover part 5, a second strut 3*b* for supporting the outside thereof, and a third strut 3*c* for supporting the rear thereof.

The first strut 3*a* and the second strut 3*b* may be formed to be gathered together at a portion connected to the sole cover part 5. In addition, the third strut 3*c* may be connected to the sole cover part 5 at the (rear) side of the heel part 1.

When the strut part 3 is provided with the three or more struts 3*a*, 3*b*, and 3*c*, which may be provided to have a linear shape and various curved shapes, since they may connect and support various points of the sole cover part 5, the weight-bearing structure of the high-heeled footwear having linear contact with the ground may provide a variety of designs to the high-heeled footwear.

In the fourth embodiment of the present invention, the first strut 3*a* and the second strut 3*b* may be symmetrical to each other to be connected to the front side of the sole cover part 5. Middle portions of the first strut 3*a* and the second strut 3*b* may protrude in a direction toward the front side to have a curved shape when viewed from the side. The fourth embodiment of the present invention may maximize the impact absorption by an elastic property and maintain the beauty of the appearance.

Figure 19:
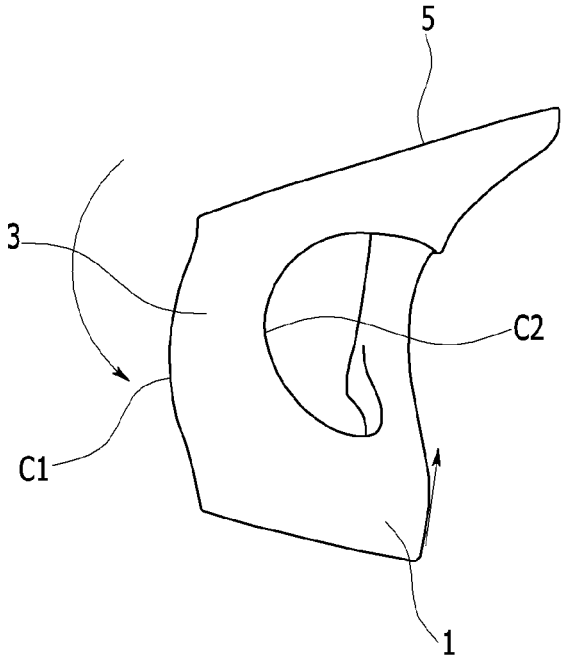
FIG. 19 illustrates a schematic view of a weight-bearing structure of high-heeled footwear for explaining a fifth embodiment of the present invention.

FIG. 19 illustrates a perspective view of a weight-bearing structure of high-heeled footwear for explaining a fifth embodiment of the present invention.

Compared with the aforementioned embodiments, features of the fifth embodiment that are different from the aforementioned embodiments will be mainly described, and a description of the same features as those of the aforementioned embodiments follows that of the aforementioned embodiments.

The strut part 3 of the weight-bearing structure of the high-heeled footwear having linear contact with the ground according to the fifth embodiment of the present invention may be provided to have a shape curved in a front direction. Preferably, a rear side curvature c2 of the strut part 3 may be greater than a front side curvature c1 thereof. In the fifth embodiment of the present invention may not be provided the front side curvature c1 but only with the rear side curvature c2.

In this case, the impact from the ground may be better absorbed as the rear side of the high-heeled footwear falls down toward the ground during the heel strike when viewed from the side. Therefore, the rotational moment, which rotates the weight-bearing structure of the high-heeled footwear in a downward direction toward the ground, may also decrease due to the reduction of the ground reaction force (GRF).

Figure 20:
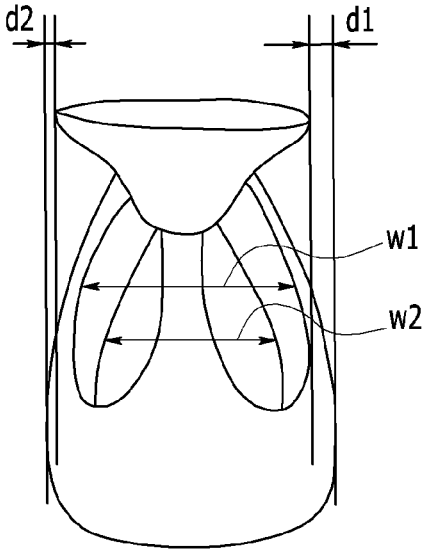
FIG. 20 illustrates a rear view of a weight-bearing structure of high-heeled footwear according to a sixth embodiment of the present invention.

FIG. 20 is a schematic view for explaining a difference of a width between the anterior and posterior portions of the strut part 3 of the weight-bearing structure of the high-heeled footwear having linear contact with the ground according to the sixth embodiment of the present invention.

Compared with the aforementioned embodiments, features of the sixth embodiment that are different from the aforementioned embodiments will be mainly described.

A width w1 between the struts at the posterior portion of the strut part 3 may be wider than a width w2 between the struts at the anterior portion thereof.

Alternatively, when the strut part 3 is provided with one strut as in the first embodiment, it is preferable that a maximum width of the posterior portion (the rear side) of the strut part 3 be wider than the width of the anterior portion (the front side) thereof.

Such a structure may increase the beauty of the appearance while supporting the weight load more stably.

The heel part 1 and the strut part 3 are provided with protrusions protruding in a width direction to be larger than the width of the sole cover part 5, so that the distances d1 and d2 may be formed (as shown in FIG. 20). The distance d1 is formed by a lateral protruding portion protruding toward the lateral side as compared with the sole cover part 5, and the distance d2 is formed by a medial protruding portion protruding toward the medial side as compared with the sole cover part 5. The protruding portions may include one of the distance d1 or the distance d2, or may include both the distance d1 and the distance d2. It is preferable that the distance d1 formed by the lateral protruding portion is wider than the distance d2 formed by the medial protruding portion in a case in which the distance d1 formed by the lateral protruding portion and the distance d2 formed by the medial protruding portion are both formed.

If the width between the struts at the anterior portion of the strut part 3 made of the elastic material is narrower than the width between the struts at the posterior portion thereof, or the strut part 3 is provided with only one strut so that the maximum width of the strut part 3 is larger than the width between the free ends of the anterior portion thereof, the impact energy is absorbed through the widening of the posterior portion of the strut part 3. The bending and the return of the strut part 3 cause a delayed transfer of absorbed energy, which allows smoother movements of the joints.

The distance d1 of the lateral protrusion and the distance d2 of the medial protrusion may allow the base of support (BOS) to be provided to be wider than that of the barefoot standing or barefoot walking, thereby providing greater stability than the case of the bare foot.

Figure 21:
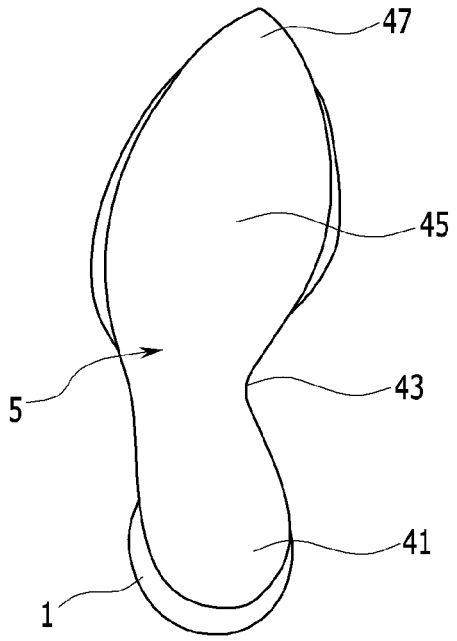
FIG. 21 illustrates a top plan view of a sole cover part entirely covering a foot in a weight-bearing structure of high-heeled footwear for explaining a seventh embodiment of the present invention.

FIG. 21 illustrates a top plan view of a sole cover part 5 entirely covering a foot in a weight-bearing structure of high-heeled footwear for explaining a seventh embodiment of the present invention.

Compared with the aforementioned embodiments, features of the seventh embodiment that are different from the aforementioned embodiments will be mainly described.

The sole cover part 5 of the seventh embodiment of the present invention may include a heel cover part 41, a foot-arch cover part 43, a foot-ball cover part 45, and a toe cover part 47 covering a toe region from below. When the sole cover part 5 includes all of the heel cover part 41, the foot-arch cover part 43, the foot-ball cover part 45 and the toe cover part 47, the sole cover part 5 may serve as an outsole.

Figure 22:
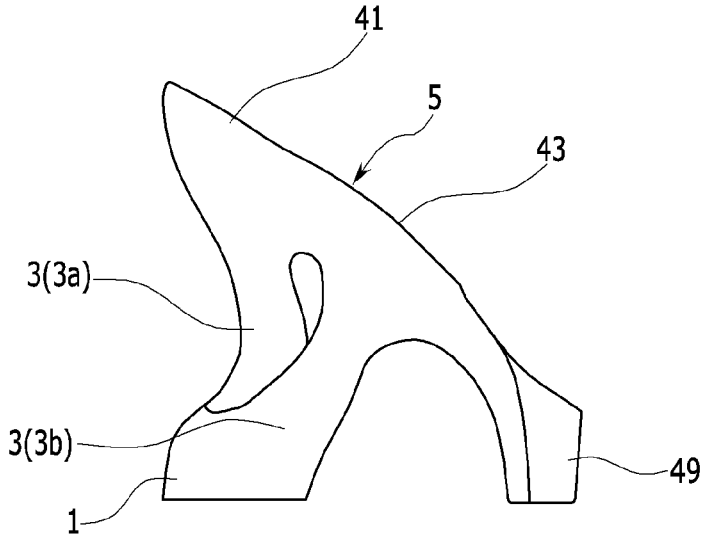
FIG. 22 illustrates a side view of a weight-bearing structure of high-heeled footwear for explaining an eighth embodiment of the present invention.

FIG. 22 illustrates a side view of a weight-bearing structure of high-heeled footwear for explaining an eighth embodiment of the present invention.

Compared with the aforementioned embodiments, features of the eighth embodiment that are different from the aforementioned embodiments will be mainly described.

The strut part 3 of the eighth embodiment of the present invention may be configured to have two or more struts 3*a* and 3*b*, and in this case, it may include a first strut 3*a* for supporting the heel cover part 41 from below and a second strut 3*b* for supporting the foot-arch cover part 43 from below.

The first strut 3*a* may extend from the heel part 1 and be connected to the heel cover part 41. The second strut 3*b* may extend from the heel part 1 and be connected to the foot-arch cover part 43. The structure of the eighth embodiment of the present invention is a case in which the sole cover part 5 extends to the foot-arch cover part 43.

The foot-arch cover part 43 may include an extension part 49, of which a bottom surface protrudes to extend to the ground.

According to the weight-bearing structure of the high-heeled footwear according to the eighth embodiment of the present invention, the strut part 3 is connected to the foot-arch cover part 43 extending from the sole cover part 5, thereby providing a variety of designs to the high-heeled footwear.

Figure 23:
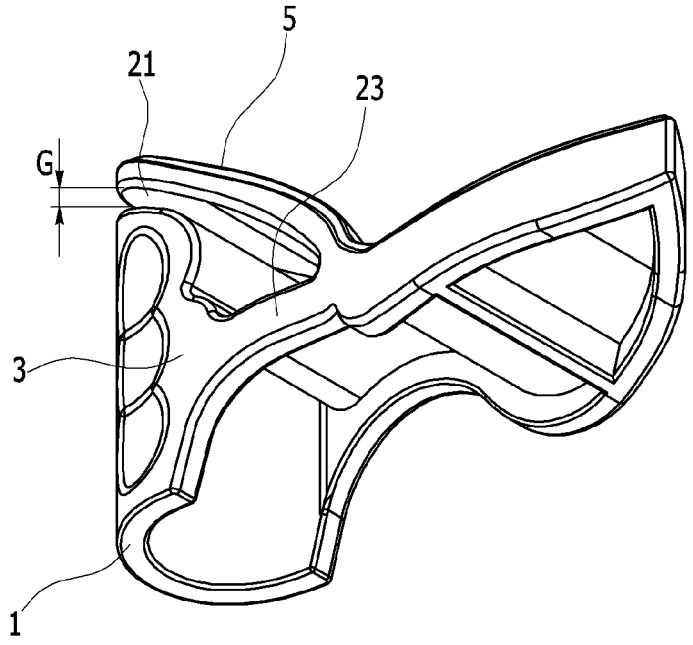
FIG. 23 illustrates a perspective view of a space part and a connecting part of a weight-bearing structure of high-heeled footwear according to a ninth embodiment of the present invention.

FIG. 23 illustrates a bottom perspective view of a space part and a connecting part of a weight-bearing structure of high-heeled footwear according to a ninth embodiment of the present invention.

Compared with the aforementioned embodiments, features of the ninth embodiment that are different from the aforementioned embodiments will be mainly described.

The weight-bearing structure of the ninth embodiment of the present invention may include a space part 21 having a constant gap G between a heel region of the sole cover part 5 and the strut part 3. The space part 21 may serve to buffer an impact by elastic force when the sole cover part 5 supports the load. The ninth embodiment of the present invention may meet the needs of consumers by increasing the total height of the weight-bearing structure of the high-heeled footwear while reducing the height of the strut part 3.

In addition, in the weight-bearing structure of the ninth embodiment of the present invention, a connecting part 23 may be provided between the sole cover part 5 and the strut part 3.

In the ninth embodiment of the present invention, the strut part 3 extends to the foot-arch part or the foot end.

Figure 24:
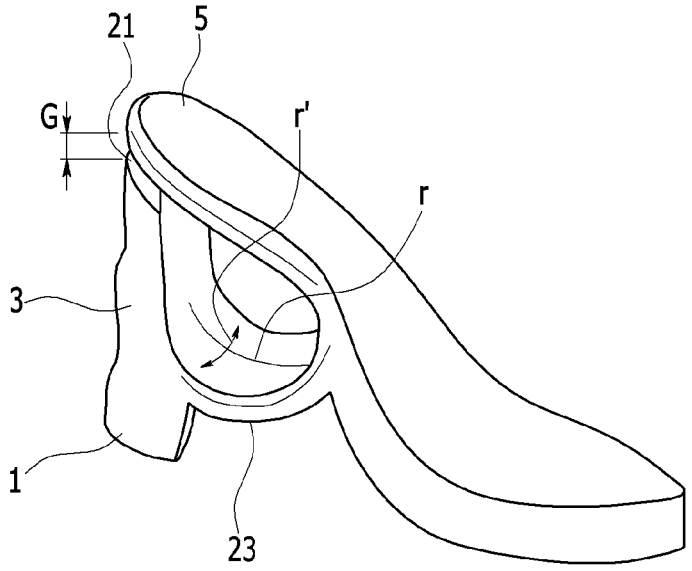
FIG. 24 illustrates a perspective view for explaining a curved portion of a connecting part in a weight-bearing structure of high-heeled footwear according to a tenth embodiment of the present invention.

FIG. 24 illustrates a perspective view of a weight-bearing structure of high-heeled footwear for explaining a tenth embodiment of the present invention.

Compared with the aforementioned embodiments, features of the tenth embodiment that are different from the aforementioned embodiments will be mainly described.

The tenth embodiment of the present invention has a shape in which the connecting part 23 is curved in a direction toward the ground. That is, the connecting part 23 may have both a curvature (r) in a longitudinal direction of the foot and a curvature (r') in a width direction of the foot.

The weight-bearing structure of the high-heeled footwear according to the tenth embodiment of the present invention may absorb an impact generated during the heel strike by the heel part of the sole cover part 5 and the connecting part 23 that are bent during the heel strike. Particularly, in the tenth embodiment of the present invention, when the connecting part 23 has both directions of curvature (r and r'), an impact-absorbing effect may be increased because the connecting part 23 is simultaneously bent in the longitudinal direction and the width direction.

Figure 25:
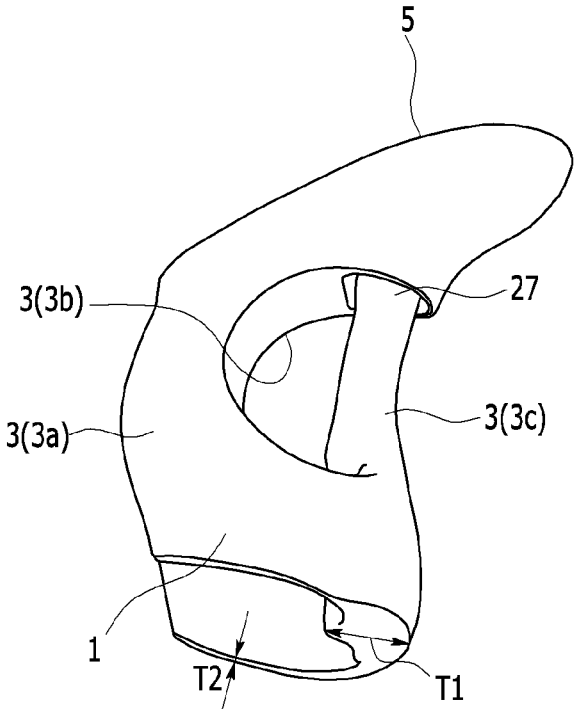
FIG. 25 illustrates a bottom perspective view for explaining a groove part of a stopper in a weight-bearing structure of high-heeled footwear according to an eleventh embodiment of the present invention.
Figure 26:
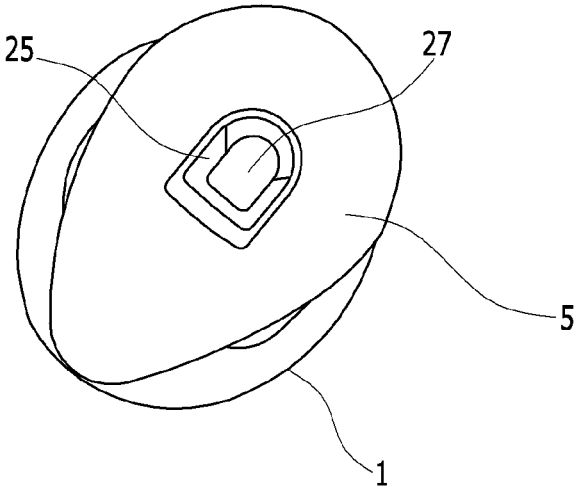
FIG. 26 illustrates a top plan view of a groove part of a stopper in a weight-bearing structure of high-heeled footwear according to an eleventh embodiment of the present invention.

FIG. 25 is a bottom perspective view of a weight-bearing structure of high-heeled footwear of an eleventh embodiment of the present invention, and FIG. 26 is a top plan view of FIG. 25.

Compared with the aforementioned embodiments, features of the eleventh embodiment that are different from the aforementioned embodiments will be mainly described.

The weight-bearing structure of the high-heeled footwear having linear contact with the ground according to the eleventh embodiment of the present invention may be provided with a groove part 25 at the inside of the sole cover part 5. The groove part 25 may be penetrate through the sole cover part 5, or may have a structure in which some of an upper surface of the sole cover part 5 is blocked. A stopper 27 inserted into the groove part 25 may be provided in an upper portion of the strut part 3. When the stopper 27, which is the upper portion of the strut part 3, is inserted into the groove part 25, the stopper 27 may be supported on a lateral surface of the sole cover part 5 when the stopper 27 is moved by an external impact, thus the stopper 27 may perform a stopper function.

In the eleventh embodiment of the present invention, it is described that the stopper 27 is inserted into the groove part 25, but the present invention is not limited thereto, and a structure in which the sole cover part 5 and the strut part 3 are spaced apart from each other by a predetermined distance is also possible.

The weight-bearing structure of the high-heeled footwear having linear contact with the ground according to the eleventh embodiment of the present invention may provide an aesthetically pleasing design effect in which the strut part 3 and the sole cover part 5 are actually separated, but they appear to be connected to each other.

Like the tenth embodiment, the eleventh embodiment of the present invention is capable of absorbing the impact while walking by the elastic action of the strut part 3.

When the weight-bearing structure of the high-heeled footwear according to the eleventh embodiment of the present invention includes the space part 21 and the connecting part 23, or the groove part 25 and the connecting part 23, the impact caused by the heel strike may be absorbed by the sole cover part 5 that is bent toward the space part 21 or the groove part 25 and by the connecting part 23 that is bent in one direction.

Figure 27:
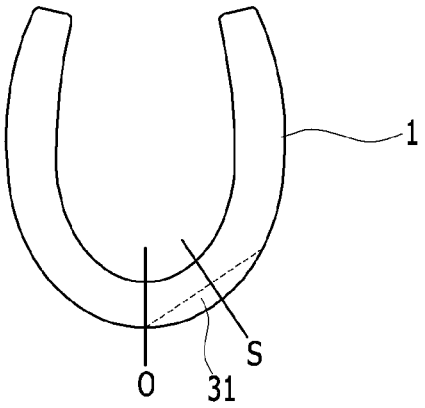
FIG. 27 illustrates a bottom view showing a heel-strike part of a weight-bearing structure of high-heeled footwear according to a twelfth embodiment of the present invention.
Figure 28:
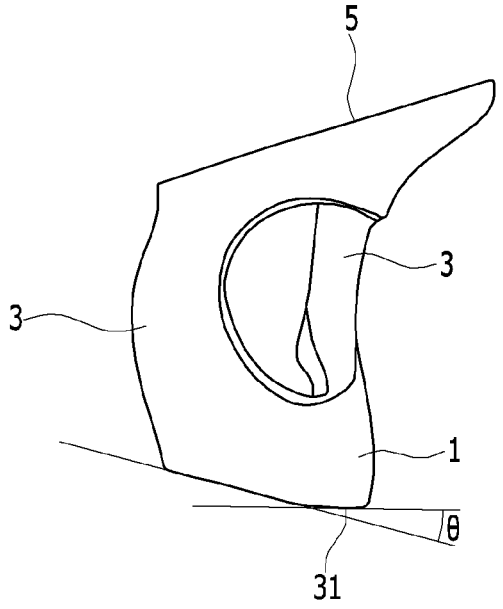
FIG. 28 illustrates a view for explaining an angle between a heel-strike part of a weight-bearing structure of high-heeled footwear according to a twelfth embodiment of the present invention and a bottom surface of a heel part.

FIG. 27 illustrates only a heel part of a weight-bearing structure of high-heeled footwear according to a twelfth embodiment of the present invention, which is viewed from the ground side. FIG. 28 illustrates a schematic view of the weight-bearing structure of the high-heeled footwear for explaining the twelfth embodiment of the present invention, which is viewed from the side.

Compared with the aforementioned embodiments, features of the twelfth embodiment that are different from the aforementioned embodiments will be mainly described.

In the twelfth embodiment of the present invention, a heel strike part 31 is provided in the heel part 1. The heel strike part 31 is provided at a rear side of a bottom surface of the heel part 1 contacting the ground during the heel strike of the heel part 1. The heel strike part 31 may be formed to have various shapes, for example, a flat surface forming a predetermined angle with the bottom surface of the heel part 1, or a round bottom forming a predetermined angle with the ground surface. The heel strike part 31 may be provided so as to be the widest in a middle of a rear side and become narrow inwardly and outwardly. The heel strike part 31 may be provided at one side of the posterior portion, and more preferably, the heel strike part 31 may be provided so as to be the widest in a posterolateral portion S and gradually narrower away from the posterolateral portion S based on the posterolateral portion S, which is first in contact with the ground during the heel strike.

The heel strike part 31 may provide a function of dispersing the impact and the weight load occurring while walking. In the swing phase, when the high-heeled footwear is worn, the foot is in a rigid state, since the foot bones are locked together, in which the joint movements are severely restricted. In this condition, entering the heel strike stage does not cause enough eversion in the subtalar joint, thus there is a limit in absorbing and dispersing the impact and weight load.

The heel strike part 31 may serve to cause a smooth and delayed movement of the subtalar joint and lower limb during the heel strike.

In the twelfth embodiment of the present invention, it is preferable that the heel strike part 31 is formed at a predetermined angle (θ), for example 8 to 25 degrees, with the bottom surface of the heel part 1.

Figure 29:
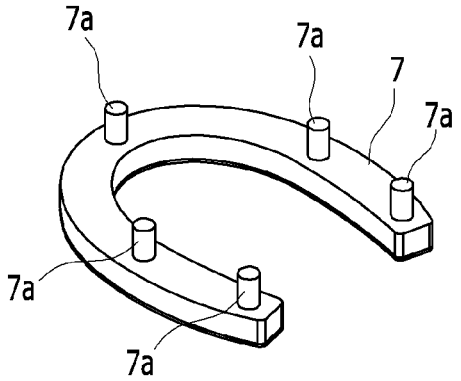
FIG. 29 illustrates a schematic view for explaining a ground contacting part of a weight-bearing structure of high-heeled footwear according to a thirteenth embodiment of the present invention.

FIG. 29 illustrates main features of a weight-bearing structure of high-heeled footwear according to a thirteenth embodiment of the present invention.

Compared with the aforementioned embodiments, features of the thirteenth embodiment that are different from the aforementioned embodiments will be mainly described.

In the thirteenth embodiment of the present invention, a ground contacting part 7 may include a separate member coupled to the bottom surface of the heel part 1.

The ground contacting part 7 may be detachably attached to the heel part 1. The ground contacting part 7 may have a structure that may be detachably attached to the heel part 1. For example, the heel part 1 may be provided with a fitting coupling groove part 1*a*, and the ground contacting part 7 may be provided with a fitting engagement protrusion 7*a*. However, the thirteenth embodiment of the present invention is not limited thereto, and the fitting coupling groove part 1*a* of the heel part 1 and the fitting engagement protrusion 7*a* of the ground contacting part 7 may be formed to be interchanged.

The ground contacting part 7 may have the same shape as the heel part 1. In the case in which the ground contacting part 7 is included, elements that may be included in the above-described heel part 1, for example, an element conforming to the outer shape of the heel, an element linearly contacting the ground, an element having a maximum width, an element of the heel strike part 31, and the like may be included in the ground contacting part 7.

The ground contacting part 7 may provide an effect for facilitating repair of the weight-bearing structure of the high-heeled footwear.

Figure 30:
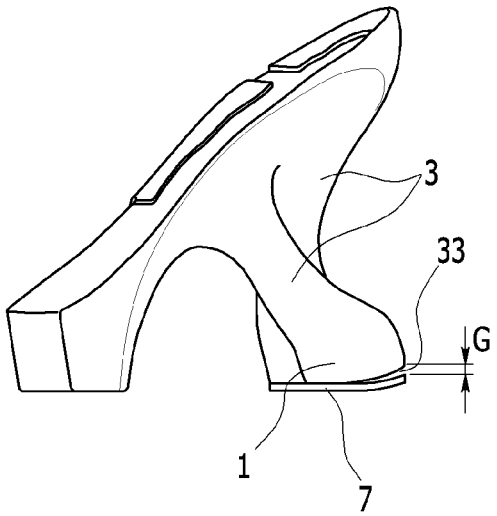
FIG. 30 illustrates a schematic view for explaining a gap of a weight-bearing structure of high-heeled footwear according to a fourteenth embodiment of the present invention.

FIG. 30 illustrates a gap part 33 of a weight-bearing structure of high-heeled footwear having linear contact with the ground according to a fourteenth embodiment of the present invention.

Compared with the aforementioned embodiments, features of the fourteenth embodiment that are different from the aforementioned embodiments will be mainly described.

The weight-bearing structure of the high-heel footwear of the fourteenth embodiment of the present invention may be provided with the gap part 33 having a predetermined space at one side between the heel part 1 and the ground contacting part 7. The gap part 33 is preferably provided between the rear regions of the heel part 1 and the ground contacting part 7.

The gap part 33 may be provided in a side posterior portion S that is initially in contact with the ground during the heel strike.

The ground contacting part 7 of the fourteenth embodiment of the present invention is preferably made of an elastic material having excellent restoring force. The ground contacting part 7 may be bonded to the heel part 1 by an adhesive, or may have a structure in which a groove or a protrusion at a portion facing the heel part 1 as in the thirteenth embodiment described above is provided, which are fitting-coupled. When the gap part 33 is included, the ground contacting part 7 may be bent by the elastic force during the heel strike, thereby absorbing the impact. The absorbed impact may be transferred so that the ground contacting part 7 is returned to its original state such that the joint may move more smoothly and with a delay.

When the gap part 33 is provided in the weight-bearing structure of the high-heeled footwear, the impact occurring during the heel strike is absorbed by the bending of the ground contacting part 7, and the absorbed impact energy may be transferred so that the ground contacting part 7 is returned to its original state such that the joint may move more smoothly and with a delay.

Figure 31:
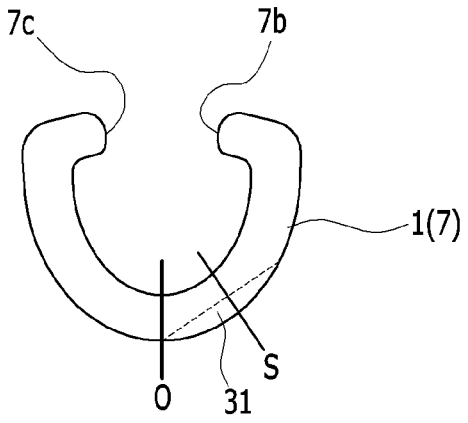
FIG. 31 illustrates a schematic view for explaining a heel part and a ground contacting part of a weight-bearing structure of high-heeled footwear according to a fifteenth embodiment of the present invention.

FIG. 31 illustrates a heel part 1 and a ground contacting part 7 of a weight-bearing structure of high-heeled footwear according to a fifteenth embodiment of the present invention.

Compared with the aforementioned embodiments, features of the fifteenth embodiment that are different from the aforementioned embodiments will be mainly described.

The weight-bearing structure of the high-heeled footwear of the fifteenth embodiment of the present invention may include ground contacting front end parts 7*b* and 7*c* provided in the ground contacting part 7. It is preferable that the ground contacting front end parts 7*b* and 7*c* extend toward a center axis O of the ground contacting part 7.

When the ground contacting front end parts 7*b* and 7*c* are included in the ground contacting part 7, the heel part 1 may include heel front end parts 1*b* and 1*c*. The heel front end portions 1*b* and 1*c* are preferably formed to have the same shape as the ground contacting front end parts 7*b* and 7*c*.

When the ground contacting part 7 includes the ground contacting front end parts 7*b* and 7*c* and the heel part 1 includes the heel front end parts 1*b* and 1*c*, since it is possible to secure a wide binding portion of the ground contacting part 7 to be coupled to the heel part 1 while the gap part 33 is formed, the heel part 1 and the ground contacting part 7 may be stably coupled even when the gap part 33 is provided. In addition, the gap part 33 may be secured more widely, and in this case, the gap part 33 may more effectively absorb the impact.

When the gap part 33 is provided in the rear side S, the ground contacting part 7 may include only the lateral ground contacting front end part 7*b*, and correspondingly, the heel part 1 may include only the lateral heel front end part 1*b*. When the gap part 33 is provided in the rear side S, even though only the lateral ground contacting front end part 7*b* and the lateral heel front end part 1*b* are included, the stability of the coupling between the heel part 1 and the ground contacting part 7 and the more effective impact absorbing effect by the gap part 33 may be obtained.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. A weight-bearing structure of a high-heeled footwear, comprising:

a heel part linearly contacting the ground;

a strut part extending from the heel part; and a sole cover part extending from the strut part, wherein the heel part has a curved contact surface contacting the ground, the curved contact surface forms a curve configured to correspond to an outline of a wearer's heel, and the curved contact surface surrounds a void space disposed inside of the curve and wherein the sole cover part is inseparably fixed to a heel portion of the high-heeled footwear, thereby the weight-bearing structure forms a heel that is integrated with the high-heeled footwear.

2. The weight-bearing structure of the high-heeled footwear of claim 1, wherein the heel part is formed to have a width of 2.12 cm or more.

3. The weight-bearing structure of the high-heeled footwear of claim 1, wherein the strut part includes two or more struts.

4. The weight-bearing structure of the high-heeled footwear of claim 3, wherein the struts are disposed to be parallel or symmetrical to each other.

5. The weight-bearing structure of the high-heeled footwear of claim 3, wherein the struts are formed to have different shapes, or at least one thereof has a different shape from those of the other struts.

6. The weight-bearing structure of the high-heeled footwear of claim 1, wherein a heel strike part is provided in a rear region of the heel part.

7. The weight-bearing structure of the high-heeled footwear of claim 6, wherein the heel strike part is formed at one side of a rear region with respect to a center of the rear region.

8. The weight-bearing structure of the high-heeled footwear of claim 1, wherein the strut part is formed to have a forward curved shape.

9. The weight-bearing structure of the high-heeled footwear of claim 8, wherein a curvature of a posterior portion of the strut part is greater than that of an anterior portion thereof.

10. The weight-bearing structure of the high-heeled footwear of claim 1, wherein the sole cover part extends from the heel to the foot-arch part or to a foot-ball part, or extends to cover the whole sole of the foot.

11. The weight-bearing structure of the high-heeled footwear of claim 1, wherein the strut part is formed to have a shape that is curved toward the outside.

12. The weight-bearing structure of the high-heeled footwear of claim 1, wherein at least a portion of the heel part protrudes more than a width of the sole cover part when viewed in a plan view.

13. The weight-bearing structure of the high-heeled footwear of claim 1, wherein:

the sole cover part extends from the heel to a foot-arch or to a foot-ball, or extends to cover the whole sole of the foot;

the strut part and the sole cover part are connected by a connecting part; and a space part is provided between the sole cover part and the strut part.

14. The weight-bearing structure of the high-heeled footwear of claim 13, wherein the connecting part is formed to have a curved shape.

15. A high-heeled footwear, comprising the weight-bearing structure of claim 1.

16. A weight-bearing structure of a high-heeled footwear, comprising:

a heel part linearly contacting the ground;

a plurality of struts extending from the heel part; and a sole cover part extending from the struts, wherein the heel part has a curved contact surface contacting the ground, the curved contact surface forms a curve configured to correspond to an outline of a wearer's heel, and the curved contact surface surrounds a void space disposed inside of the curve and wherein the struts include one that supports one of a heel and a foot-arch part, and another that supports the other of a heel and a foot-arch part.

17. A weight-bearing structure of a high-heeled footwear, comprising:

a heel part linearly contacting the ground;

a plurality of struts extending from the heel part; and a sole cover part extending from the struts, wherein the heel part has a curved contact surface contacting the ground, the curved contact surface forms a curve configured to correspond to an outline of a wearer's heel, and the curved contact surface surrounds a void space disposed inside of the curve and wherein a groove part is provided at a lower portion of the sole cover part, and a stopper inserted into the groove part is formed by extending an upper portion of the strut part.

18. A weight-bearing structure of a high-heeled footwear, comprising:

a heel part linearly contacting the ground;

a plurality of struts extending from the heel part; and a sole cover part extending from the struts, wherein the heel part has a curved contact surface contacting the ground, the curved contact surface forms a curve configured to correspond to an outline of a wearer's heel, and the curved contact surface surrounds a void space disposed inside of the curve, wherein a ground contacting part, which linearly contacts the ground in midstance, is coupled to the heel part, and wherein a gap part is provided between the heel part and the ground contacting part.

* * * * *